US005256239A

United States Patent [19]

Voltmer et al.

[11] Patent Number: 5,256,239

[45] Date of Patent: Oct. 26, 1993

[54] CONTINOUSLY MOVING WEB PRESSURE-SENSITIVE LABELER

[75] Inventors: Helmut Voltmer, Hackettstown, N.J.; Urs Reuteler, Lebanon, N.H.

[73] Assignee: New Jersey Machine Inc., Lebanon, N.H.

[21] Appl. No.: 837,754

[22] Filed: Feb. 18, 1992

Related U.S. Application Data

[63] Continuation-in-part of Ser. No. 695,425, May 3, 1991.

[51] Int. Cl.[5] ..... B65C 9/00

[52] U.S. Cl. ..... 156/362; 156/351; 156/361; 156/542; 156/567

[58] Field of Search ..... 156/351, 361, 362, 363, 156/521, 540, 541, 542, 567

[56] References Cited

U.S. PATENT DOCUMENTS

| | | | |
|---|---|---|---|
| 3,791,904 | 2/1974 | Schlacht | 156/571 |
| 3,915,448 | 10/1975 | Total | 156/571 X |
| 4,239,570 | 12/1980 | Kerwin | 156/363 X |
| 4,324,608 | 4/1982 | Klinger | 156/351 |
| 4,585,506 | 4/1986 | Matsuguchi | 156/542 X |
| 4,610,753 | 9/1986 | Voltmer et al. | 156/571 X |
| 4,687,535 | 8/1987 | Voltmer | 156/363 X |
| 4,844,760 | 7/1989 | Dickey | 156/578 X |

*Primary Examiner*—David A. Simmons
*Assistant Examiner*—James J. Engel, Jr.
*Attorney, Agent, or Firm*—Charles E. Baxley

[57] ABSTRACT

A continuously moving web pressure-sensitive labeler applies pressure-sensitive labels to articles moving in a given direction past a label applying station. The labels are initially carried by the moving web and the labeler includes a label applying mechanism such as a peel plate and a vacuum drum for stripping labels from the moving web and delivering the stripped labels in the given direction onto articles as they pass the label applying station in the given direction. The labeler also has mechanism which generates a timing signal for timing the placing of labels in register on the label applying mechanism. In a first embodiment, the timing signal generating mechanism includes an encoder driven by the drum and also includes a rotary vacuum valve. In a second embodiment, the labeler includes a conveyor for carrying articles past the label applying station and a timing screw for orienting articles on the conveyor in evenly spaced single file manner, and the mechanism for generating a timing signal includes an encoder driven by the timing screw.

2 Claims, 2 Drawing Sheets

CONTINOUSLY MOVING WEB PRESSURE-SENSITIVE LABELER

RELATED APPLICATION

This is a continuation-in-part of copending U.S. patent application Ser. No. 695,425 filed May 3, 1991.

BACKGROUND OF THE INVENTION

This invention relates to a labeler and more particularly to a continuously moving web pressure-sensitive labeler. Still more particularly, this invention is an important improvement over the labeling system of prior U.S. Pat. No. 4,842,660 which issued Jun. 27, 1989, on application Ser. No. 225,669 filed Jul. 27, 1988, in the names of Helmut Voltmer (one of the present inventors), Alfred F. Schwenzer and Anthony Freakes. Application Ser. No. 225,669 was a continuation of abandoned application Ser. No. 045,315 filed May 4, 1987, which in turn was a continuation of application Ser. No. 845,524 filed Mar. 28, 1986, now U.S. Pat. No. 4,687,535 which issued Aug. 18, 1987. Prior U.S. Pat. Nos. 4,687,535 and 4,842,660 are commonly assigned herewith.

In the labeling system disclosed by the aforesaid prior U.S. Patents, pressure-sensitive labels are applied to articles or containers at a label-applying station. Labels are carried initially by a web, and the system comprises a supply spindle which supports a supply roll including the web carrying the labels thereon. The articles to be labeled are continuously advanced in a given direction past the label-applying station, and the web with the labels thereon is advanced continuously from the supply spindle. Labels are stripped from the web at a label pick-up station and the stripped labels are placed on a vacuum drum that continuously advances the stripped labels in the given direction to meet the articles at the label-applying station. The speed of advance of the articles and the speed of advance of the web are sensed continuously and the speed of advance of the web is adjusted as necessary to match the speed of advance of the articles.

A pressure-sensitive labeler with an intermittently moving web enables good control of the tension in the web, in order to (1) prevent web slack at the rewind roll, (2) guarantee good tracking of the web, (3) have the right tension over the peel plate o (where labels are stripped from the web), (4) avoid web breakage and (5) provide enough freedom of the web to be able to bring labels up to the desired speed of the products being labeled.

Tension control thus is very important in obtaining good web flow. The desired tension to meet these five requirements is not always possible because of speed and strength of the web paper. When a compromise is necessary, registration is affected. As used herein, "registration" refers to accuracy in placing a label in a desired location on a product.

Another important feature of a pressure-sensitive labeler with a continuously moving web is the capability of matching accurately label speed with product speed at the label-applying station. If this matching of speed is not accurate, registration will be off.

The aforesaid prior U.S. Patents disclose driving a continuously moving web by a constantly driven feedroller engaging one side of the web with a lift roller engaging the other side of the web directly opposite the feedroller, so that in normal operation the feedroller and the lift roller bight the web directly opposite the feedroller and the lift roller is movable out of engagement with the web to a retracted position to activate a brake, causing the brake to engage and stop the web. The engagement of the feedroller with the web is essentially tangent where a lift roller is used.

Another known means for driving an intermittently moving web utilizes a stepping motor which permits greater circumferential engagement or wraparound of the web with the feedroller and hence more traction to overcome web tension. However, the step increments are too great for fine registration and speed is a limitation.

A further known means for driving an intermittently moving web utilizes a clutch and brake which gives more wraparound of the web on the feedroller than is obtainable with a light roller, but the clutch and brake means are subject to clutch slippage due to varying tension, causing registration problems.

With a continuously moving web, tension control is needed only in peeling labels from the web at a peel plate, and for tracking. Tracking a continuously moving web is easier than tracking a web that comes to rest intermittently.

Further, in the system of the aforesaid prior U.S. Patents, a vacuum drum is rotated at a linear speed that is greater than the speed at which labels are delivered to the outer surface of the drum, so that the outer surface of the drum slips on each label with vacuum being applied to a vacuum passage at a label pick-up station, so that vacuum picks up each label whereby labels are spaced uniformly on the drum from the label pick-up station to the label applying station.

It is an important object of the present invention to provide a continuously moving web pressure-sensitive labeler with much improved label pitch flexibility and control.

Another important object of the invention is to provide such a continuously moving web pressure-sensitive labeler which enables complete control of label pitch over an infinite continuum of possible label pitches.

An additional important object of the invention is to provide such a labeler which reduces tearing of the web.

The foregoing and other objects and advantages of the invention will appear more clearly hereinafter.

SUMMARY OF THE INVENTION

The invention relates to a continuously moving web pressure-sensitive labeler for applying pressure-sensitive labels to articles moving in a given direction past a label applying station, wherein the labels are initially carried by the moving web. The labeler comprises label applying means for stripping labels from the moving web and delivering the stripped labels in the given direction onto articles as they pass the label applying station in the given direction. The stripping means include a peel plate, and the label applying means for delivering stripped labels onto articles include a vacuum drum. Means including an encoder generate a timing signal for timing the placing of labels in register on the label applying means.

In a first form of the inventive labeler, the vacuum drum has a plurality of label panels each with vacuum holes in open communication with the outer drum surface and the means for generating a timing signal further include a rotary vacuum valve. The first inventive labeler also comprises a servomotor which controls and drives the rotary vacuum valve and means programming the servomotor to maintain its effectiveness when the labeler speed is changed up or down. The first form of the inventive labeler further comprises a web feedroll and first and second switches, wherein whenever the first switch is activated, the second switch checks the label position on the web and if necessary gives instructions to the feedroll to advance or retard the label feed rate. In the first inventive labeler, the encoder is driven by the vacuum drum.

In a second form of the inventive labeler, the vacuum drum is non-segmented and has vacuum ports evenly spaced around its entire peripheral surface. The second inventive labeler also comprises a conveyor for carrying articles in the given direction past the label applying station and a rotatable timing screw for orienting articles on the conveyor in evenly spaced single file manner.

Also in the second inventive labeler, the means for generating a timing signal include an encoder driven by the timing screw so that one revolution of the encoder corresponds to one revolution of the timing screw and hence to one pitch of the articles on the conveyor. The timing screw has an article exit end confronting the label applying station and the encoder is adjacent such article exit end.

In the second inventive labeler, the vacuum drum is rotated such that its outer peripheral surface has a peripheral velocity that is related to the linear velocity of the conveyor in o a predetermined ratio to achieve desired transfer of labels to the articles at the label applying station.

With further reference to the second inventive labeler, while the terminal label is still adhered to the web, the outer peripheral surface of the vacuum drum is allowed to slip on the terminal label prior to complete release of the terminal label from the web at the peel plate.

The second inventive labeler also comprises a sensor that is movable along the path of the web in advance of the peel plate such that during initial setup, the movable sensor is positionable so that the leading edge of the terminal label is at the peel plate just as the leading edge of another label further back on the web covers the movable sensor and is thus in proper register therewith.

The feedroll of the second inventive labeler advances the web past the movable sensor to the peel plate, so that at start-up of the labeler, the feedroll moves the web so that the leading edge of the terminal label just covers the movable sensor and the labeler further comprises an additional sensor positioned transversely of the conveyor between the timing screw and the label applying station and activated by the initial article in a continuous flow of articles upon exiting from the timing screw to signal the start of the label feed sequence, in which the encoder gates the start signal for driving the web and the feedroll accelerates the web to substantially the correct web speed, as determined by the speed of the containers and the pitch of labels on the web, so that the label pitch and the article pitch assume a one-on-one relationship and the movable sensor detects the leading edge of a label and if the leading edge is out of position, the movable sensor causes the feedroll to make compensating correction to synchronize the occurrence of the index pulse generated by the encoder with the instant when the leading label edge passes the movable sensor, the correction being effected by increasing or decreasing web speed as required.

DESCRIPTION OF THE INVENTION

Figure 1:
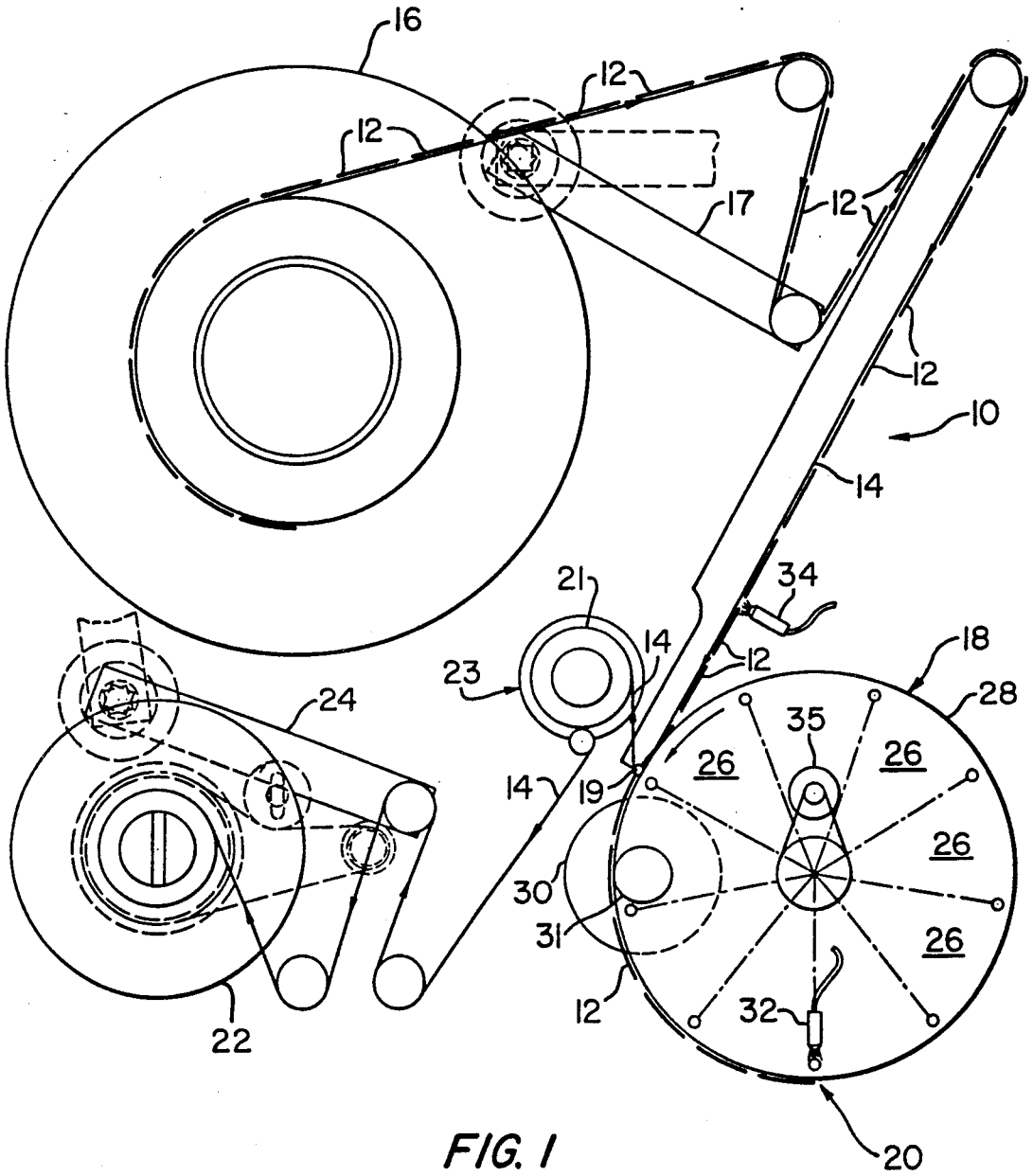
FIG. 1 is a somewhat schematic view of a first labeler embodying the invention.

FIG. 1 shows a continuously moving web pressure-sensitive labeler 10 that is a first labeler embodying the invention for applying pressure-sensitive labels 12 that are initially carried by a web 14 from a label unwind disc 16 to a label applying drum 18 after passing over a tension control lever 17. Drum 18 applies a vacuum to the labels 12, thereby stripping them from web 14 at a peel plate 19 and carrying stripped labels 12 to a label applying station indicated generally at 20 where the Vacuum is released and labels 12 are applied to articles. A feedroll 21 driven by a servomotor 23 advances web 14 to drum 18. After labels 12 are stripped from web 14, web 14 is wound on a backing material rewind disc 22 after passing over a tension control lever 24.

As shown, label applying drum 18 has nine pie-shaped label panels 26, but this can vary. Each panel 26 has vacuum holes in open communication with the outer surface 28 of drum 18.

Rotary means 30 controls the vacuum, and a servomotor 31 or like means (not shown) controls and drives rotary means 30, and means are provided for programming servomotor 31 to maintain its effectiveness when the labeler speed is changed up or down. The rotary means 30 controls the timing of the vacuum that places labels 12 in register o drum 18. Rotary means 30 includes a rotary valve, particularly a rotary vacuum valve.

Labeler 10 also comprises a first switch, sensor or signal 32 and a second switch, sensor or signal 34 so that whenever first switch or signal 32 is asserted, second switch or signal 34 checks the position of labels 12 on web 14 and if necessary, gives instructions to feedroll 21 to advance or retard the label feed rate.

Labeler 10 further comprises an encoder 35 or similar means for regulating different label pitches. Encoder 35 may advantageously be mounted on a one-revolution shaft driving an infeed worm.

Figure 2:
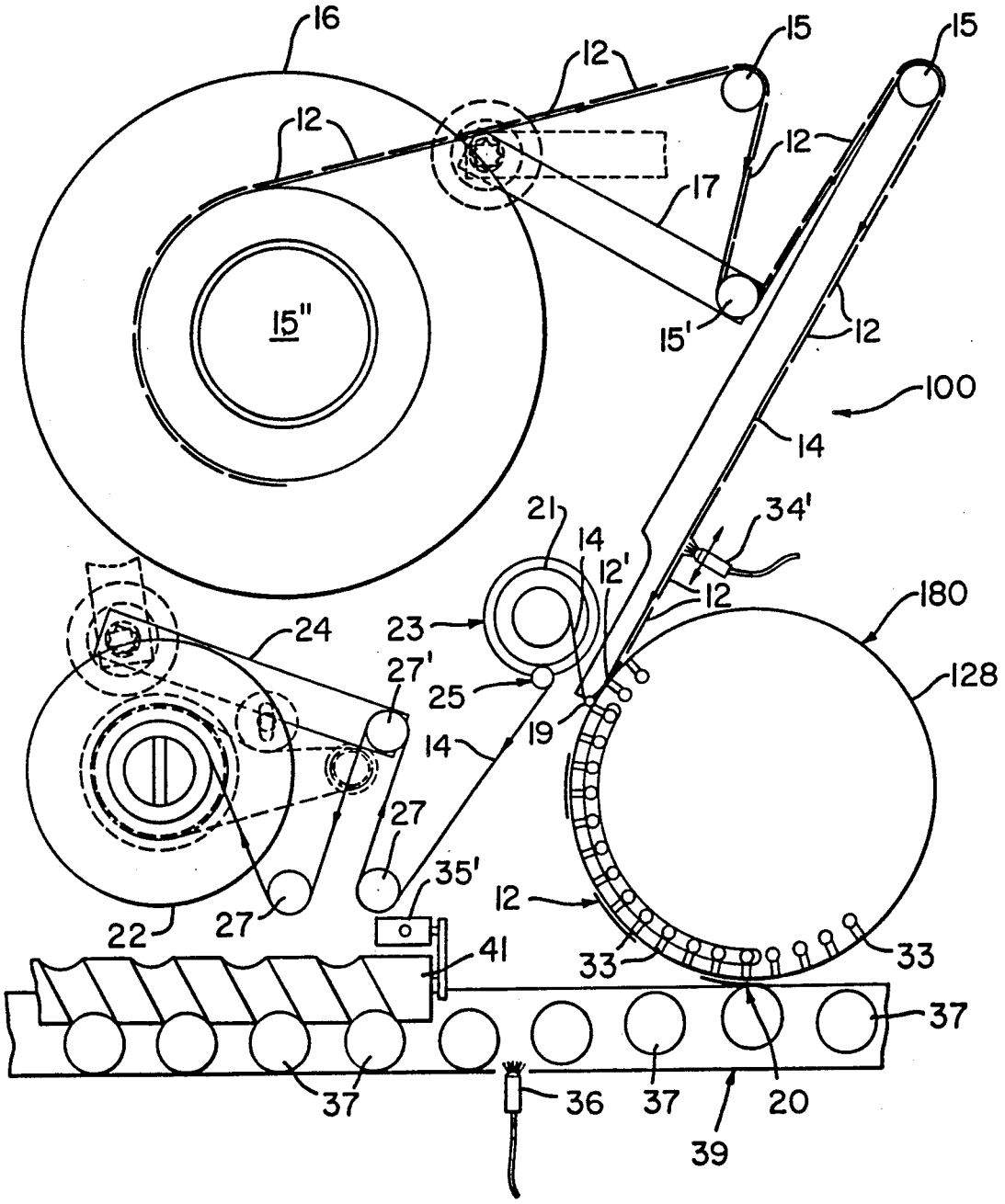
FIG. 2 is a view similar to FIG. 1 showing a second labeler embodying the invention.

FIG. 2 shows a continuously moving web pressure-sensitive labeler 100 that is a second labeler embodying the invention. Certain parts of labeler 100 are common to labeler 10 and have the same reference characters. Certain other parts are common to labelers 10 and 100 but have reference characters in FIG. 2 only.

Labeler 100 applies pressure-sensitive labels 12 that are initially carried by web 14 from label unwind disc 16 via guide rolls 15 and 15' to a label applying device 180. Guide roll 15' is rotatably mounted to tension control lever 17 which applies a constant tension to web 14 and further controls the action of a clutch (not shown) connected to unwind spindle 15'' carrying unwind disc 16.

Web 14 is routed around peel plate 19 and around the outer surface of feedroll 21. Feedroll 21 is driven by servomotor 23. Web 14 further continues around pressure roll 25, guide roller 27 and rewind sensor roller 2' which is rotatably mounted to tension control lever 24 and is finally rewound on backing material rewind disc 22.

Label applying device 180 is shown as a non-segmented vacuum drum that rotates in the counterclockwise direction as seen in FIG. 2, and that carries vacuum ports 33 evenly spaced around its entire outer peripheral surface 128. Vacuum ports 33, of which there are sufficiently few to do the job, are connected to a constant source of vacuum through a valve plate (not shown) carrying vacuum channels (not shown), such that vacuum is present at outer peripheral surface 128 from a location in proximity to peel plate 19 to label applying station 20.

Containers or other articles 37 are carried by a conveyor 39 from left to right as seen in FIG. 2 past label applying station 20, containers 37 having been evenly spaced on conveyor 39 by a timing screw 41 in an uninterrupted flow.

An encoder 35' is located adjacent the container exit end of timing screw 41 and is driven thereby to provide means for generating a timing signal so that one revolution of encoder 35' corresponds to one revolution of timing screw 41 and hence exactly one pitch of containers 37 on conveyor 39. Peripheral outer surface 128 of label applying drum 180 has a peripheral velocity that is related to the linear velocity of conveyor 39 in a predetermined ratio to achieve the desired label transfer at label applying station 20. Labels 12 are sequentially stripped from transport web 14 by peel plate 19 and captured and held by vacuum against outer peripheral surface 128 of label applying drum 180. While the terminal label 12' is still adhered peripheral outer surface 128 of label applying drum 180 is allowed to slip if necessary on terminal label 12' prior to complete release of such terminal label 12' from web 14 at peel plate 19.

During initial setup of labeler 100, a movable switch, sensor or signal 34' is moved to be positioned along the path of web 14 in advance of peel plate 19 such that the leading edge of the terminal label 12' is at the peel plate 19 just as the leading edge of another label 12 further back on web 14 covers sensor 34', i.e. is in proper register therewith. The movability of sensor 34' is indicated by the two-headed arrow traversing sensor 34'.

On operation at start-up feedroll 21 moves web 14 so that the leading edge of terminal label 12' just covers sensor 34'. The initial article or container 37 in a continuous flow of articles or containers 37 during operation activates a switch, sensor or signal 36, which signals the start of the label feed sequence as follows, it being noted that encoder 35' rotates exactly one revolution per article or container, and with each revolution, encoder 35' generates an index pulse or window:

The next programmed index pulse or window of encoder 35' gates the start signal for the web drive. Feedroll 21 accelerates web 14 to substantially the correct web speed, which is determined by the conveyor speed and the label pitch, so that the label pitch and the article or container pitch assume an exact one-on-one relationship. Encoder 35' rotates exactly one revolution per article or container, and with each revolution, encoder 35' generates an index pulse or window. Movable sensor 34' detects the leading edge of a label 12 during this index period, and if the leading edge is out of position, movable sensor 34' causes a control unit for feedroll 21 to make the compensating correction to synchronize the occurrence of the index pulse generated by encoder 35' with the instant when a label edge passes sensor 34', by increasing or decreasing web speed as required.

Successive labels 12 are dispensed in a continuous flow onto outer surface 128 of label applying drum 180 and carried by it to label applying station 20 and there transferred to continuously moving articles or containers 37 in a one-for-one relationship.

The transfer can be a passing contact, whereby container 37 and outer surface 128 of label applying drum 180 move at a matching velocity, or a rolling contact, whereby outer surface 128 of applying drum 180 moves faster (e.g. twice the velocity) than container 37 to rotate container 37 as well as to move container 37 at a linear velocity.

The position of the label on the container can be adjusted by repositioning sensor 34'. Container or bottle location can be adjusted by retiming timing screw 41.

While the label applying devices of labelers 10 and 100 are illustrated as segmented vacuum drum 18 in FIG. 1 and nonsegmented vacuum drum 180 in FIG. 2, the label applying device need not be a vacuum drum. It could be an electrostatically charged drum or other device capable of transporting labels from one point to another. Also, the timing signal can be generated by means other than encoder 35 or 35'. Alternatively to encoder 35', a resolver or a PLC with a timing pulse as the index mark could be used to generate the timing signal.

It is apparent that the invention attains the stated objects and advantages among others. The disclosed details are exemplary only and are not to be taken as limitations on the invention except as such details are included in the appended claims.

What is claimed is:

1. A continuously moving web pressure-sensitive labeler for applying pressure-sensitive labels to articles moving in a given direction past a label applying station, wherein the labels are initially carried by the moving web, said labeler comprising label applying means for stripping labels from said moving web and delivering the stripped labels in said given direction onto articles as they pass said label applying station in said given direction, and means for generating a timing signal for timing the placing of labels in register on said label applying means, wherein said stripping means include a peel plate, further comprising a conveyor for carrying articles in said given direction past said label applying station and a rotatable timing screw for orienting articles on said conveyor in evenly spaced single file manner, wherein said means for generating a timing signal include an encoder that is driven by said timing screw so that one revolution of said encoder corresponds to one revolution of said timing screw and hence to one pitch of said articles on said conveyor, wherein said timing screw has an article exit end confronting said label applying station and said encoder is adjacent said article exit end of said timing screw, wherein said vacuum drum is rotated such that its outer peripheral surface has a peripheral velocity that is related to the linear velocity of said conveyor in a predetermined ratio to achieve desired transfer of labels to the articles at said label applying station, wherein while a terminal label is still adhered to the web, said outer peripheral surface of said vacuum drum is allowed to slip on said terminal label prior to complete release of said terminal label from said web at said peel plate, further comprising a sensor that is movable along the path of the web in advance of said peel plate such that during initial setup of said labeler said movable sensor is positionable such that the leading edge of said terminal label is at said peel plate just as the leading edge of another label further back on said web covers said movable sensor and is thus in proper register therewith.

2. A labeler according to claim 1 further comprising a feedroll for advancing the web past said movable sensor to said peel plate, so that at start-up of said labeler, said feedroll moves the web so that the leading edge of the terminal label just covers said movable sensor and said labeler further comprises an additional sensor positioned transversely of said conveyor between said timing screw and said label applying station and activated by the initial article in a continuous flow of articles upon exiting from said timing screw to signal the start of the label feed sequence, in which said encoder gates the start signal for driving the web and said feedroll accelerates the web to substantially the correct web speed as determined by the speed of said containers and the pitch of labels on the web, so that the label pitch and article pitch assume a one-on-one relationship and said movable sensor detects the leading edge of a label and if the leading edge is out of position said movable sensor causes said feedroll to make compensating correction to synchronize the occurrence of the index pulse generated by said encoder with the instant when the leading edge of a label passes said movable sensor, the correction being effected by increasing or decreasing web speed as required.

* * * * *